US005253443A

United States Patent [19]

Baikrich

[11] Patent Number: 5,253,443

[45] Date of Patent: Oct. 19, 1993

[54] LASER-BEAM AIMING DEVICE

[76] Inventor: Michel Baikrich, 42 Xhierfomont, 4086 Stoumont, Belgium

[21] Appl. No.: 838,414

[22] PCT Filed: Oct. 16, 1990

[86] PCT No.: PCT/BE90/00059

§ 371 Date: Mar. 9, 1992

§ 102(e) Date: Mar. 9, 1992

[87] PCT Pub. No.: WO91/19157

PCT Pub. Date: Dec. 12, 1991

[30] Foreign Application Priority Data

Jun. 6, 1990 [BE] Belgium ..... 9000571

[51] Int. Cl.[5] ..... F41G 1/35

[52] U.S. Cl. ..... 42/103; 362/110

[58] Field of Search ..... 42/103; 89/41.17; 362/110, 111, 112, 113, 114

[56] References Cited

U.S. PATENT DOCUMENTS 4,916,713 4/1990 Gerber ..... 372/109
5,033,219 7/1991 Johnson et al. ..... 42/103

FOREIGN PATENT DOCUMENTS 2357544 5/1975 Fed. Rep. of Germany .
3501321 8/1985 Fed. Rep. of Germany .
422270 2/1935 United Kingdom .
511195 9/1939 United Kingdom .

*Primary Examiner*—Stephen C. Bentley
*Attorney, Agent, or Firm*—Seidel, Gonda, Lavorgna & Monaco

[57] ABSTRACT

The laser generator (20) is mounted in a sleeve (13) in such a way that its barrel (22) is held by three support elements (25,25',30) two of which consist of a sliding part (25,25') having a bearing surface (24,24') extending in an oblique plane with respect to the axial plane which is perpendicular to the radial direction of the support element in question, while the oblique bearing surface (24,24') of each sliding part coacts with a rib (23) projecting from the outer surface of the barrel (22) of said laser generator (20). The side of the sliding part (25,25'), which is opposite the above mentioned bearing surface having a thread (26,26'), engages a thread formed on the inner surface of a ring (28,29) so that the rotation of the ring (28,29) moves the sliding part (25,25') along the axis of the sleeve (13) in a direction parallel thereto, while the above mentioned oblique bearing surface (24,24') moves the axis of the laser generator barrel (22) in a direction parallel to the radial direction in question.

23 Claims, 5 Drawing Sheets

LASER-BEAM AIMING DEVICE

The present invention relates, in general terms, to a laser-beam aiming appliance intended to be fastened to a firearm in order to make it easier to aim it at a target. It is concerned particularly with an improved mode of construction and especially a device for axial positioning of the laser generator.

A laser-beam aiming or sighting appliance takes the form of an elongate housing, in which are accommodated a laser generator, an electrical-energy source for supplying the laser generator, and an axial-positioning device for adjusting the axial position of the laser generator on the inside of the housing, in order to orient the axis of the laser beam in such a way that, at a predetermined distance from the firearm to which the aiming appliance is fastened, the axis of the laser beam coincides with the axis of the barrel of the firearm.

In the known laser-beam aiming or sighting appliances, the axial positioning of the laser generator is carried out by means of adjusting screws. An alternative embodiment is described in U.S. Pat. No. 2,715,275 relating to a sighting telescope. The axial alignment of this appliance is obtained by means of two radial plungers arranged in two planes perpendicular to one another, the first plunger being displaceable longitudinally in order to ensure adjustment in elevation, and the second plunger being displaceable longitudinally in order to ensure adjustment in azimuth or drift. The displacement of each plunger is controlled by means of a ring. With such a device, however, the adjustment in elevation and in azimuth is limited to a displacement corresponding to one revolution of the corresponding ring, that is to say to 360°.

Now it has been found that, although a laser-beam aiming or sighting appliance makes sighting easier, especially when the gunner is working under poor lighting conditions, the laser beam reproduces the least tremor of the firearm. Moreover, an adjustment of the laser beam is practicable only for a precisely determined distance because the laser beam has a perfectly straight path, whereas the projectile has a curved path. The adjustment of the beam as a function of the distance of the target is therefore an especially difficult problem which calls for a very high fineness of adjustment.

The object of the present invention is to afford a solution to this problem by providing an aiming or sighting appliance equipped with an arrangement capable of ensuring an adjustment of the direction of the laser beam with a fineness and accuracy higher than those which the known devices allow.

There is provided, according to the invention, a laser-beam aiming or sighting appliance, in which the laser generator is mounted on the inside of a sleeve, in such a way that the gun of the laser generator is held by three bearing members arranged in angular positions spaced from one another, a first bearing member being arranged in a radial position located in a vertical axial plane, whilst a second bearing member is arranged in a radial position located in a horizontal axial plane.

Each of the first and second bearing members consists of a slide having a bearing face which extends in a plane oblique relative to the axial plane perpendicular to the radial direction of the bearing member under consideration, the oblique face of each slide co-operating with a rib provided on the outer surface of the gun of the laser generator. The face of the slide which is opposite the bearing face having a thread, meshes in a thread formed in the inner surface of a ring, in such a way that the rotation of the ring causes the displacement of the slide parallel to the axis of the sleeve, whilst the abovementioned oblique bearing face displaces the axis of the gun of the laser generator parallel to the radial direction under consideration.

In an exemplary embodiment, each of the slides passes through an orifice formed in the sleeve, and each slide is coupled to a separate ring which extends coaxially relative to the sleeve. The rib which co-operates with the oblique face of each slide extends on the periphery of a bush which surrounds the gun of the laser generator.

Advantageously, the laser generator is mounted on a cardanic suspension fastened on the inside of the sleeve. The rib provided on the bush which delimits the gun of the laser generator is maintained constantly in contact with the oblique bearing faces of the slides by means of a spring which extends radially between the inner surface of the sleeve and the bush.

By means of the invention, the adjustment in elevation and in drift can be carried out continuously with very high fineness, for example with a variation according to a travel corresponding to a rotation of two complete revolutions of each ring.

According to another aspect of the invention, the laser generator is mounted in a housing having an electrical-energy source, the electrical-energy source being connected electrically to a first contact member, whilst the electronic control circuit of the laser generator is connected electrically to a second contact member, said first and second contact members being connected electrically to one another by means of an electrically conductive ball when this ball is brought into contact with said first and second contact members by a pusher which is displaced when a trigger member is actuated.

Preferably, the aiming appliance is mounted removably on an adaptor intended for fastening the appliance rigidly to the body of a firearm, which adaptor comprises a shackle intended for partially girdling the body of a firearm, one end of said shackle carrying a pivot, about which a clamping lever is articulated. One end of the clamping lever has a nose formed so as to be capable of co-operating with the surface of a locking cylinder when said clamping lever is in the clamping position, the locking cylinder being mounted elastically on the shackle in such a way that the abovementioned nose exerts a retraction pressure on the locking cylinder.

In an exemplary embodiment, the locking cylinder is mounted on at least one spring in a receptacle formed in the shackle. The locking cylinder is hollow and extends around a retaining axle fastened in the cylinder receptacle.

By means of the elastically mounted locking cylinder, the appliance according to the invention can be fastened to the body of the firearm with a clamping force which is distributed over the entire length of the adaptor, thereby ensuring a perfectly rigid fastening on the firearm. This rigid fastening, by means of which the aiming appliance ideally becomes integral with the firearm, contributes to obtaining a highly accurate aiming at a target.

The appliance according to the invention not only has the great advantage of allowing a very fine adjustment of the alignment with a target and consequently a highly accurate sighting of the target, but also has the advantage of being easy to assemble, thereby making its production easier.

Other particular and advantageous aspects of the

Other particular and advantageous aspects of the invention will emerge from a reading of the following description which will be made with the aid of the accompanying drawings which illustrate an exemplary embodiment.

Figure 1:
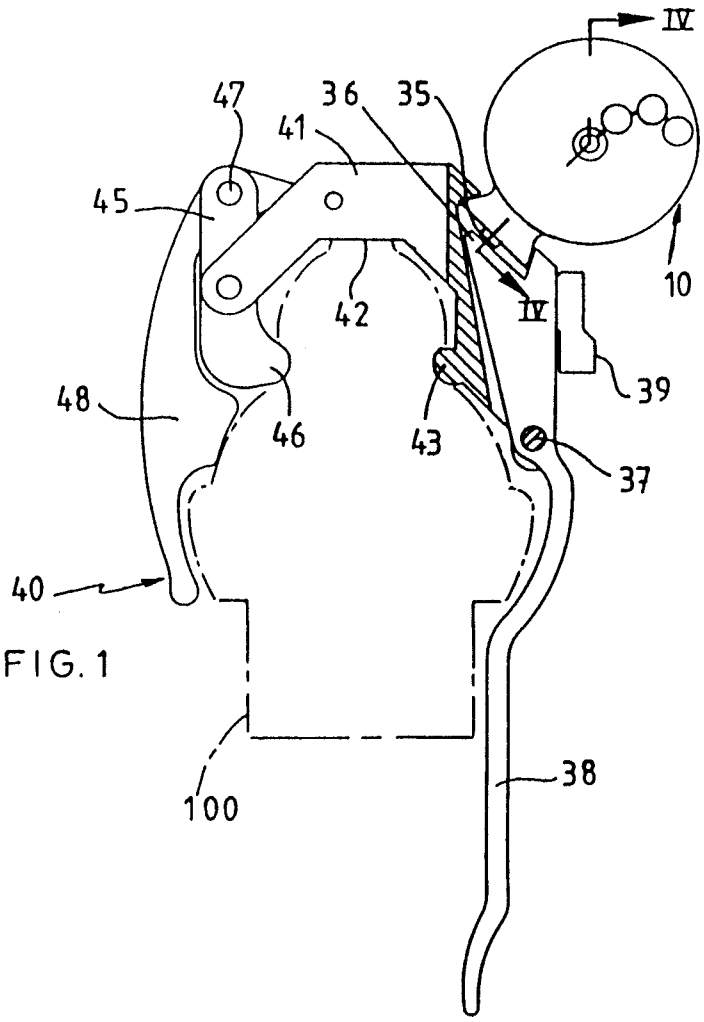
FIG. 1 is a rear view of the aiming appliance according to the invention.
Figure 2:
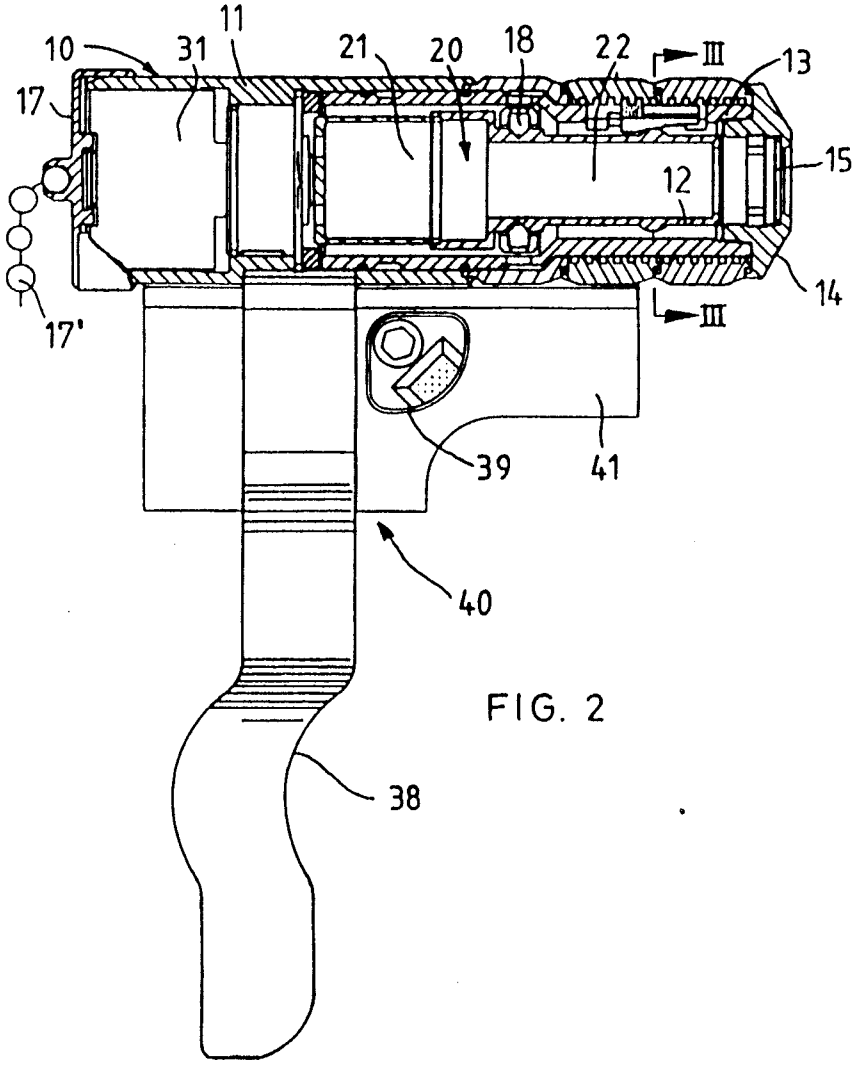
FIG. 2 is a side elevation view of the appliance illustrated in FIG. 1.

FIGS. 1 and 2 show a laser-beam aiming appliance 10 fastened removably to a firearm by means of an adaptor 40. The line designated by the reference symbol 100 represents the exemplary contour of the body of a firearm. The adaptor 40 is provided so that, when it is fastened to a small arm or shoulder arm, the aiming appliance 10 is in an angular position offset laterally relative to the vertical axial plane of the firearm.

The laser-beam aiming appliance 10 can be seen particularly in partial section in FIG. 2. The appliance comprises a housing 11, in which are accommodated a laser generator 20, an energy source 31 for supplying the laser generator, and a trigger mechanism for making the electrical connection between the energy source and the laser generator in order to produce a laser beam, that is to say a beam of coherent light.

The laser generator 20 comprises electronic control circuit 21 having a laser diode, the laser diode being known per se. The elements of the laser generator are enclosed in a bush 12 forming a gun 22 for projecting the laser beam produced by the laser diode when the latter is excited. The bush 12 is fastened on the inside of a sleeve 13 which extends from the housing 11. The free end of the sleeve 13 is closed by means of a head 14 pierced with an aperture, shut off by a glass plate 15 arranged opposite the orifice of the gun 22 of the laser generator, in order to allow the laser beam to pass outwards. The rear end of the housing 11 is closed by means of a removable cover 17 allowing access to the electrical-energy source 31, for example cells. The cover 17 is advantageously attached to the housing 11 by means of a small chain 17', to prevent the cover from being lost.

Inside the sleeve 13, the laser generator 20 is mounted on a cardanic suspension 18 fastened to a sleeve 13, and its axial positioning is ensured by a mechanism serving for adjusting the alignment in elevation and in azimuth of the axis of the laser beam in relation to the barrel of the firearm on which the appliance is mounted, so as to adjust the distance at which the axis of the laser beam coincides with the axis of the barrel of the firearm. The innovation resides not so much in the function of this mechanism, which is necessary and well known, as in the special mechanical arrangement provided according to the invention for performing this alignment function, with specific advantages in terms of the accuracy and fineness of the adjustment.

Figure 3:
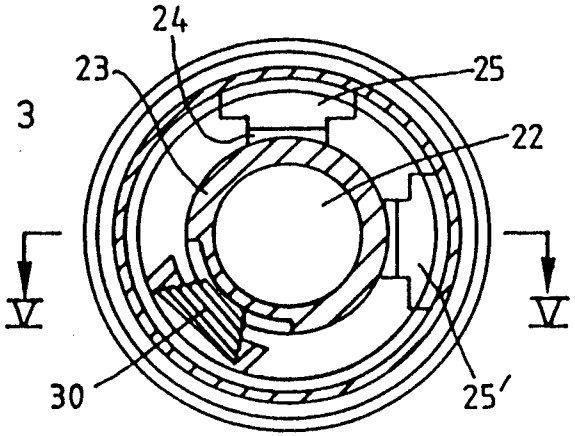
FIG. 3 is a section along the line III—III of FIG. 2.

As shown in the cross-section of FIG. 3, the outer surface of the gun 22 of the laser generator is held by three bearing members arranged in angular positions spaced from one another. A first bearing member 25 is arranged in a radial position located in a vertical axial plane. A second bearing member 25' is arranged in a radial position located in a horizontal axial plane. A third bearing member 30 is arranged in such a radial position that the axis of this bearing member preferably bisects the angle formed by the radial planes of the first two bearing members.

Figure 4:
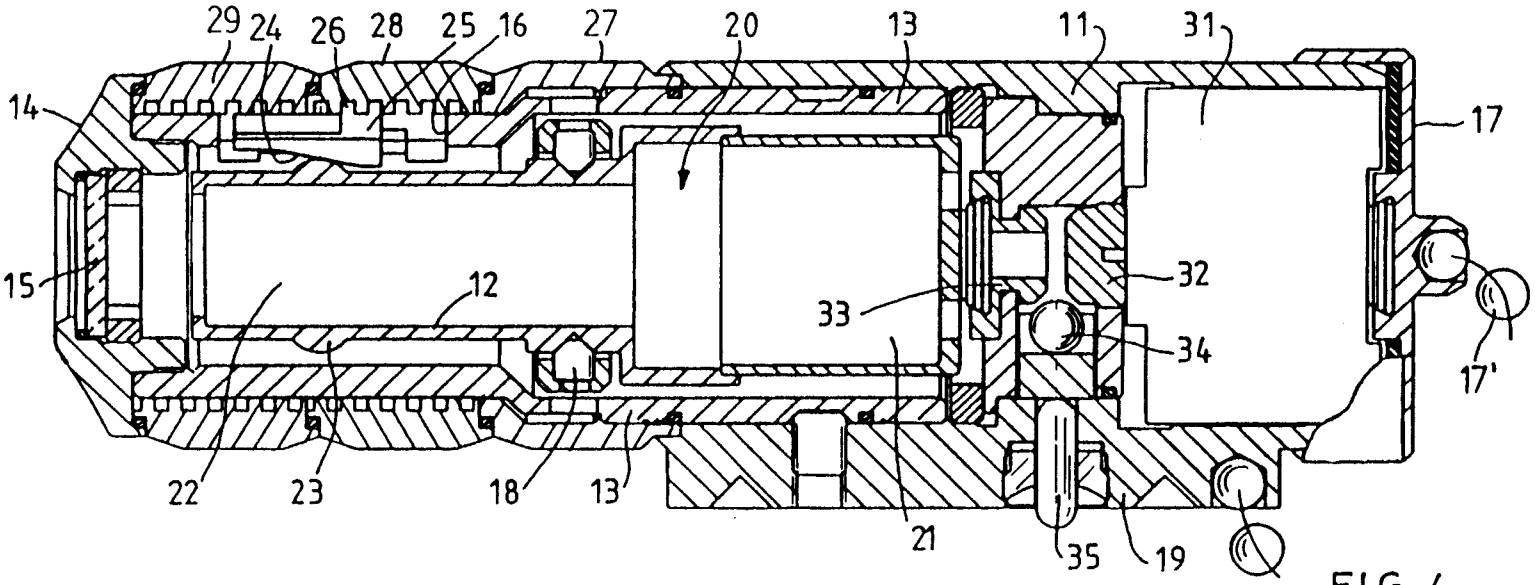
FIG. 4 shows a section along the line IV—IV of FIG. 1.

Referring particularly to FIG. 4, the outer surface of the bush 12 which delimits the gun 22 of the laser generator has an annular rib 23. This rib co-operates with a bearing face 24 which belongs to a slide 25 extending longitudinally along the generatrix of the bush 12. The slide 25 passes radially through an orifice 16 cut out from the sleeve 13. The bearing face 24 extends longitudinally in a plane oblique relative to the horizontal axial plane of the sleeve. The opposite longitudinal face of the slide 25 has a thread 26 which meshes in a complementary thread formed on the inner surface of a ring 28. When this ring is rotated, its internal thread drives the slide 25 which thus slides parallel to the longitudinal axis of the sleeve 13, whilst the rib 23, which remains in contact with the oblique face 24, follows the inclination of this bearing face 24, and from that moment the longitudinal axis of the gun 22 is displaced in a vertical plane. The inclination of the axis of the gun of the laser generator varies continuously and uniformly in proportion as the thread of the ring 28 travels along an angular path which can greatly exceed 260°. In an exemplary embodiment, the adjustment in elevation varies over a travel corresponding to a rotation of two complete revolutions of the ring, thereby ensuring a high fineness of adjustment which no other known means of mechanical adjustment can achieve.

Figure 5:
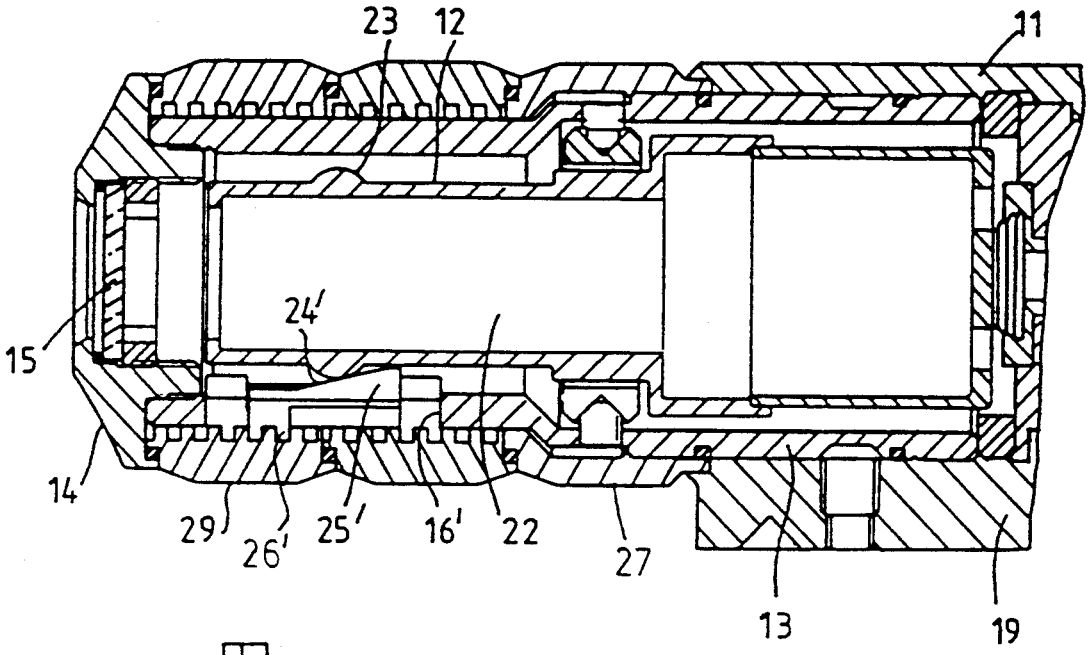
FIG. 5 is a section along the line V—V of FIG. 3.
Figure 6:
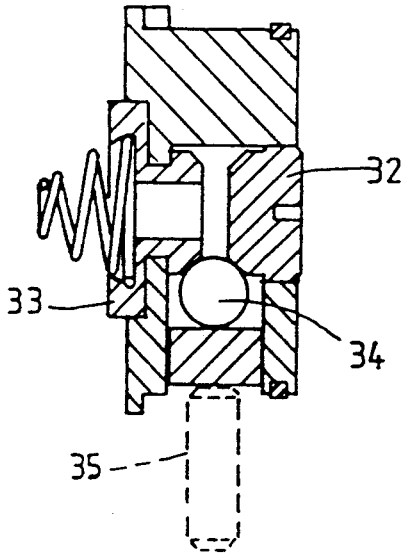
FIG. 6 is a section on an enlarged scale through the contactor mounted in the appliance according to the invention.

The rib 23 co-operates in a similar way with a bearing face 24, which belongs to the slide 25' (FIG. 5). The bearing face 24' extends longitudinally in a plane oblique relative to the vertical axial plane of the sleeve. The opposite longitudinal face of the slide 25' has a thread 26' which meshes in a complementary thread formed on the inner surface of the ring 29. When the latter is rotated, its internal thread drives the slide 25' which thus slides parallel to the longitudinal axis of the sleeve 13, whilst the rib 23 follows the inclination of the bearing face 24'. The longitudinal axis of the gun 22 is thereby displaced in a horizontal plane. The inclination of the axis of the gun of the laser generator varies from that moment continuously and uniformly in proportion as the thread of the ring 29 travels along an angular path of more than 360°. For example, the adjustment in drift can vary over a travel corresponding to a rotation of two complete revolutions of the ring, thereby ensuring a high fineness of adjustment which no other known means of mechanical adjustment can achieve.

The third bearing member consists of a spring 30 (FIG. 3) which exerts a radial pressure on the bush 12, which delimits the gun 22 of the laser generator, in order to maintain the rib 23 constantly in contact with the oblique bearing faces of the two slides 25 and 25'. The spring 30 is fastened at its ends in receptacles provided in the outer surface of the bush 12 and in or on the inner surface of the sleeve 13. It goes without saying that the bush 12 could have a separate rib for co-operating with each bearing slide.

By means of the axial-positioning device according to the invention, the setting of the aiming at a target can be adjusted with a much greater fineness than with the prior devices, thus ensuring a much more accurate sighting. Moreover, this device is assembled on an aiming or sighting appliance easily and quickly.

The laser generator 20 is triggered by means of a contactor mounted in the housing 11 (FIG. 4). This contactor comprises an electrically conductive ball 34 mounted in a receptacle displaceable under the action of a pusher which slides in an orifice made in the base 19 of the housing 11. When the pusher is displaced upwards (this occurring under the action of a trigger member provided on the fastening adaptor 40 which will be described later), the ball 34 is lifted and comes into contact with two contact pieces 32 and 33. The contact piece 32 is connected electrically to the electrical-energy source 31; the contact piece 33 is connected electrically to the electronic control circuit 21 of the laser generator. When the ball 34 has come into contact with the contact pieces 32 and 33, an electrical connection is made between the energy source 31 and the control circuit 21 of the laser generator 20 which then produces a laser beam.

As mentioned above, the aiming appliance 10 is mounted on an adaptor making it possible to fasten the appliance removably to any firearm. The fastening adaptor 40 is shown particularly in FIGS. 1 and 2.

The adaptor 40 comprises a shackle 41 having a bearing surface 42 for bearing on the body of a firearm. In the exemplary embodiment illustrated in FIG. 1, one lateral end of the shackle 41 has a rib 43 intended for co-operating by clamping with the lateral surface of the firearm. The opposite lateral end of the shackle 41 carries a horizontal axle 44, about which pivots a lug 45, one end of which has a heel 46 intended for co-operating by clamping with the lateral surface of the firearm. The other end of the lug 45 carries a horizontal axle 47, about which pivots a clamping lever 48 shaped so as to clamp the lug 45 against the body 100 of the firearm when it is in the clamping position. In other embodiments, depending on the profile of the body of the firearm used, the shackle 41 can bear on a surface extending on the periphery of the firearm.

Figure 7:
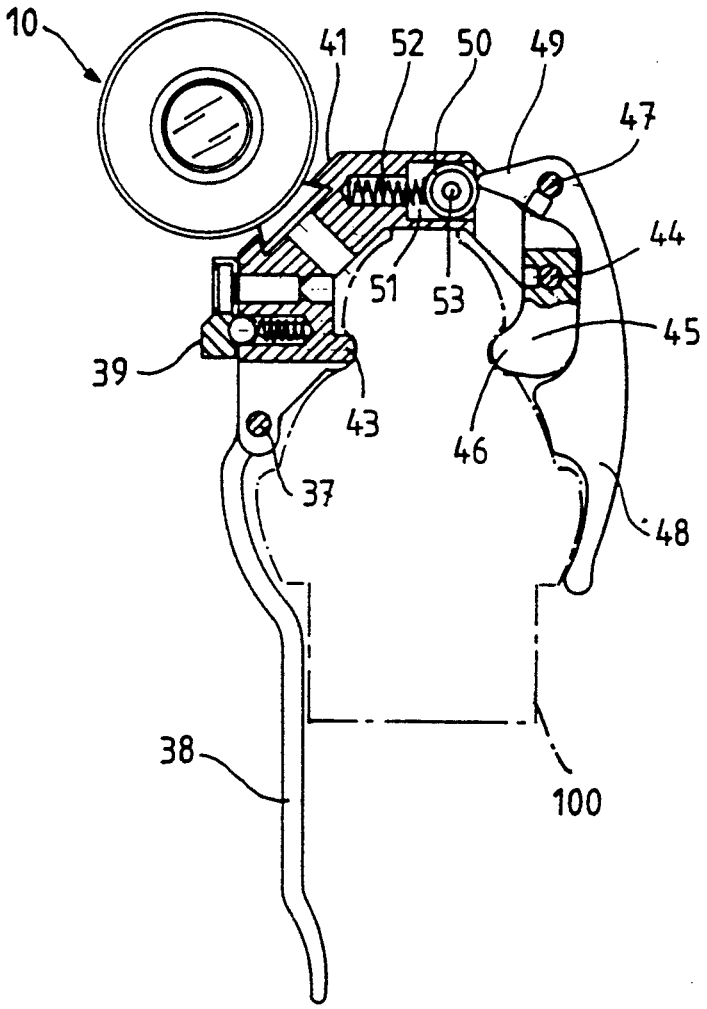
FIGS. 7 to 9 show three positions of the locking mechanism provided on the fastening adaptor of the aiming appliance illustrated in FIG. 1.

FIG. 7 shows a partial section through the shackle 41 when the appliance is seen from the front, that is to say facing the aperture of the laser projector. The clamping lever 48 has a nose 49 shaped and arranged so as to co-operate with the surface of a locking cylinder 50 mounted elastically in a receptacle 51 formed in the shackle 41. The locking cylinder 50 is a hollow cylinder, for example made of steel, which extends around a retaining axle 53 fastened in a receptacle 51. In an exemplary embodiment, the elastic mounting of the cylinder 50 is ensured by means of springs 52, for example four parallel springs distributed over the length of the cylinder and pushing the latter towards the orifice of the receptacle 51.

When the clamping lever 48 is in the clamping position (FIG. 7), the nose 49 co-operates with the locking cylinder 50 and exerts on the latter a pressure counter to the action of the spring 52 which then maintains the cylinder 50 against the lower flank of the nose 49. The latter is retained above the horizontal diametral plane of the cylinder 50, and this distributes the clamping force over the entire length of the shackle 41, thereby ensuring a rigid fastening on the firearm, the aiming appliance being integral with the firearm. On the other hand, the clamping lever 48 could not pivot accidentally and free the movement of the lug 45 because the nose 49 cannot overcome the pushing force exerted by the spring 52 when the clamping lever 48 is not stressed by a torque deliberately applied by the operator.

Figure 9:
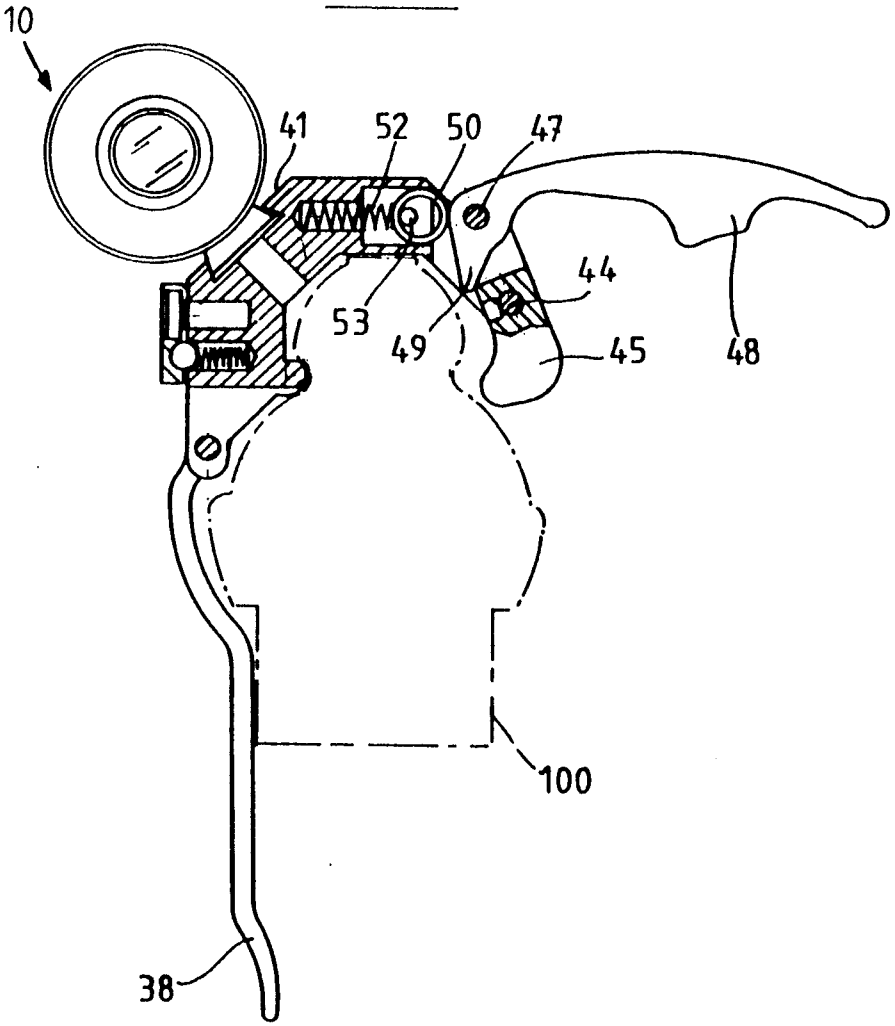
Figure 8:
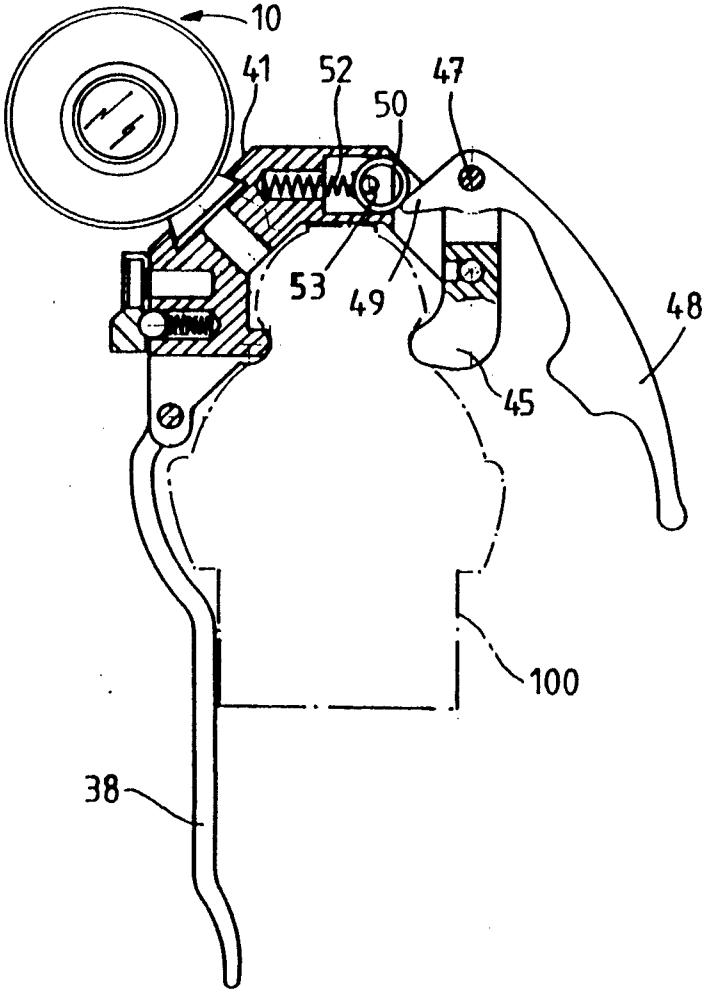

In contrast, because of the elastically mounted cylinder 50, a secure locking takes place gently. Intentional release likewise takes place gently. FIGS. 8 and 9 show the locking mechanism in two states in which the clamping lever is disengaged. In FIG. 8, the nose 49 of the clamping lever 48 is in position against the locking cylinder 50 just after release or just before locking. The cylinder 50 is then stressed to the right under the push of the relaxed spring 52; the cylinder 50 is retained by the retaining axle 53. In this state, the lug 45 still maintains its heel 46 in contact with the body of the firearm. In FIG. 9, the clamping lever 48 is shown in the completely disengaged position. The nose 49 no longer co-operates with the locking cylinder 50 and the lug 45 is likewise disengaged: the appliance can thus be separated from a firearm or be placed on and fastened to a firearm.

The shackle 41 also carries an axle 37, about which is mounted a trigger member. This takes the form of a lever 38 intended to be actuated by the gunner's hand. This lever will be called a spoon. The spoon 38 terminates in a lug 36 arranged so as to co-operate with the end of the pusher 35 which controls the contactor 34 of the laser generator, as described above (FIG. 4). A pawl 39 makes it possible to block the spoon 38 in order to prevent an accidental triggering of the laser generator.

The embodiment of the invention described in the foregoing is an example given by way of illustration, and the invention is in no way limited to this example. Any modification, any alternative version and any equivalent arrangement must be considered as included within the scope of the invention.

I claim:

1. A laser-beam aiming appliance, comprising a sleeve (13) which contains a laser generator (20) having a gun (22) held by three bearing members arranged in angular positions spaced from one another, a first bearing member being arranged in a radial position located in a vertical axial plane, whilst a second bearing member is arranged in a radial position located in a horizontal axial plane, wherein each of the first and second bearing members consists of a slide (25, 25') having a bearing face (24, 24') which extends in a plane oblique relative to the axial plane perpendicular to the radial direction of the bearing member under consideration, the oblique bearing face (24, 24') of each slide co-operating with a rib (23) projecting on the outer surface of the gun (22) of the laser generator (20), the face of the slide (25, 25') which is opposite the abovementioned bearing face having a thread (26, 26') meshing in a thread formed in the inner surface of a ring (28, 29), in such a way that the rotation of said ring (28, 29) causes the displacement of the slide (25, 25') parallel to the axis of the sleeve (13), whilst the abovementioned oblique bearing face (24, 24') displaces the axis of the gun (22) of the laser generator parallel to the radial direction under consideration.

2. The appliance as claimed in claim 1, wherein each of the slides (25, 25') passes through an orifice (16, 16') formed in the sleeve (13), each slide (25, 25') being coupled to a separate ring (28, 29) which extends coaxially relative to the sleeve (13).

3. The appliance as claimed in claim 1, wherein the rib (23) which co-operates with the oblique face (24,24') of each slide (25,25') extends on the periphery of a bus (12) which surrounds the gun (22) of the laser generator (20).

4. The appliance as claimed in claim 3, wherein the third bearing member consists of a pressure spring (30) extending radially between the inner surface of the sleeve (13) and the abovementioned bush (12).

5. The appliance as claimed in claim 1, wherein the laser generator (20) is mounted on a cardan suspension (18) fastened on the inside of the sleeve (13).

6. The appliance as claimed in claim 1, wherein the laser generator (20) comprises electronic control circuit (21), the laser generator (20) being mounted in a housing (11) having an electrical-energy source (31), the electrical energy source being connected electrically to a first contact member (32), and the electronic control circuit (21) of the laser generator (20) being connected electrically to a second contact member (33), said first and second contact members (32,33) being connected electrically to one another by means of an electrically conductive ball (34) when this ball is brought into contact with said first and second contact members (32, 33) by a pusher (35) which is displaced when a trigger member (38) is actuated.

7. The appliance as claimed in claim 1, defined in that it is mounted removeably on an adaptor (40) intended for fastening the appliance rigidly to the body (100) of a firearm.

8. The appliance as claimed in claim 7, wherein the adaptor (40) comprises a shackle (41) for partially girdling the body (100) of a firearm, one end of said shackle (41) carrying a pivot (47), about which a clamping lever (48) is articulated, one end of the clamping lever (48) having a nose (49) formed so as to cooperate with the surface of a locking cylinder (50) when said clamping lever is in the clamping position, the locking cylinder (50) being mounted elastically on the shackle (41) in such a way that the above-mentioned nose (49) exerts a retraction pressure on the locking cylinder (50).

9. The appliance as claimed in claim 8, wherein the locking cylinder (50) is mounted on at least one spring (52) in a receptacle (51) formed in the shackle (41).

10. The appliance as claimed in claim 8 or 9, wherein the locking cylinder (50) is hollow and extends around a retaining axle (53) fastened in the receptacle (51) of the cylinder (50).

11. The appliance as claimed in claim 2, wherein the rib (23) which co-operates with the oblique face (24,24') of each slide (25,25') extends on the periphery of a bush (12) which surrounds the gun (22) of the laser generator (20).

12. The appliance as claimed in claim 2, wherein the laser generator (20) is mounted on a cardan suspension (18) fastened on the inside of the sleeve (13).

13. The appliance as claimed in claim 3, wherein the laser generator (20) is mounted on a cardan suspension (18) fastened on the inside of the sleeve (13).

14. The appliance as claimed in claim 4, wherein the laser generator (20) is mounted on a cardan suspension (18) fastened on the inside of the sleeve (13).

15. The appliance as claimed in claim 2, wherein the laser generator (20) comprises electronic control circuit (21), the laser generator (20) being mounted in a housing (11) having an electrical-energy source (31), the electrical energy source being connected electrically to a first contact member (32), and the electronic control circuit (21) of the laser generator (20) being connected electrically to a second contact member (33), said first and second contact members (32,33) being connected electrically to one another by means of an electrically conductive ball (34) when this ball is brought into contact with said first and second contact members (32, 33) by a pusher (35) which is displaced when a trigger member (38) is actuated.

16. The appliance as claimed in claim 3, wherein the laser generator (20) comprises electronic control circuit (21), the laser generator (20) being mounted in a housing (11) having an electrical-energy source (31), the electrical energy source being connected electrically to a first contact member (32), and the electronic control circuit (21) of the laser generator (20) being connected electrically to a second contact member (33), said first and second contact members (32,33) being connected electrically to one another by means of an electrically conductive ball (34) when this ball is brought into contact with said first and second contact members (32, 33) by a pusher (35) which is displaced when a trigger member (38) is actuated.

17. The appliance as claimed in claim 4, wherein the laser generator (20) comprises electronic control circuit (21), the laser generator (20) being mounted in a housing (11) having an electrical-energy source (31), the electrical energy source being connected electrically to a first contact member (32), and the electronic control circuit (21) of the laser generator (20) being connected electrically to a second contact member (33), said first and second contact members (32,33) being connected electrically to one another by means of an electrically conductive ball (34) when this ball is brought into contact with said first and second contact members (32, 33) by a pusher (35) which is displaced when a trigger member (38) is actuated.

18. The appliance as claimed in claim 5, wherein the laser generator (20) comprises electronic control circuit (21), the laser generator (20) being mounted in a housing (11) having an electrical-energy source (31), the electrical energy source being connected electrically to a first contact member (32), and the electronic control circuit (21) of the laser generator (20) being connected electrically to a second contact member (33), said first and second contact members (32,33) being connected electrically to one another by means of an electrically conductive ball (34) when this ball is brought into contact with said first and second contact members (32, 33) by a pusher (35) which is displaced when a trigger member (38) is actuated.

19. The appliance as claimed in claim 2, defined in that it is mounted removeably on an adaptor (40) intended for fastening the appliance rigidly to the body (100) of a firearm.

20. The appliance as claimed in claim 3, defined in that it is mounted removeably on an adaptor (40) intended for fastening the appliance rigidly to the body (100) of a firearm.

21. The appliance as claimed in claim 4, defined in that it is mounted removeably on an adaptor (40) intended for fastening the appliance rigidly to the body (100) of a firearm.

22. The appliance as claimed in claim 5, defined in that it is mounted removeably on an adaptor (40) intended for fastening the appliance rigidly to the body (100) of a firearm.

23. The appliance as claimed in claim 6, defined in that it is mounted removeably on an adaptor (40) intended for fastening the appliance rigidly to the body (100) of a firearm.

* * * * *